US011497271B2

(12) United States Patent
Oh

(10) Patent No.: US 11,497,271 B2
(45) Date of Patent: Nov. 15, 2022

(54) SHOES

(71) Applicant: Se-Ho Oh, Osan (KR)

(72) Inventor: Se-Ho Oh, Osan (KR)

( * ) Notice: Subject to any disclaimer, the term of this patent is extended or adjusted under 35 U.S.C. 154(b) by 28 days.

(21) Appl. No.: 17/036,885

(22) Filed: Sep. 29, 2020

(65) Prior Publication Data

US 2021/0235811 A1 Aug. 5, 2021

(30) Foreign Application Priority Data

Feb. 5, 2020 (KR) ..... 10-2020-0013451
Aug. 18, 2020 (KR) ..... 10-2020-0103307

(51) Int. Cl.
*A43B 11/00* (2006.01)
*A43B 23/02* (2006.01)
*A43B 23/26* (2006.01)

(52) U.S. Cl.
CPC ..... *A43B 11/00* (2013.01); *A43B 23/027* (2013.01); *A43B 23/26* (2013.01)

(58) Field of Classification Search
CPC ..... A43B 11/00; A43B 11/02; A43B 23/22; A43B 23/08; A43B 23/088; A43B 23/26; A43B 5/00; A43B 5/048; A43B 13/41; A43C 11/004; A43C 11/08; A43C 11/1446
See application file for complete search history.

(56) References Cited

U.S. PATENT DOCUMENTS 4,608,769 A 9/1986 Sturlaugson
4,776,111 A * 10/1988 Crowley ..... A61F 5/0127 36/89
4,972,613 A * 11/1990 Loveder ..... A43B 5/00 36/105
5,557,866 A * 9/1996 Prengler ..... A43B 5/00 36/138
6,000,148 A * 12/1999 Cretinon ..... A43B 5/00 36/69
7,178,270 B2 * 2/2007 Hurd ..... A43B 11/02 36/138
7,793,438 B1 * 9/2010 Busse ..... A43B 11/02 36/105
10,455,898 B1 * 10/2019 Grand ..... A43C 11/004
10,524,542 B2 * 1/2020 Avar ..... A43B 23/08
(Continued)

FOREIGN PATENT DOCUMENTS

CN 105188450 A 12/2015
EP 3799758 * 1/2019 ..... A43B 23/08
(Continued)

*Primary Examiner* — Jillian K Pierorazio

(57) ABSTRACT

A shoe capable of maintaining shapes of an upper leather and a tongue so that a user can easily wear the shoe without bowing a waist of the user when the user wears the shoe is provided. The shoe includes a sole, an upper leather which is provided above the sole and includes a tip line forming a region into which a foot of a wearer is inserted and a first wearing guide portion which causes a rear region of the tip line to move rearward when the foot of the wearer is inserted into the shoe through the tip line. The first wearing guide portion includes a rear support portion which is elongated in a heel tab direction from a back counter, and an insertion guide portion which is provided to have a curve rearward from an upper portion of the rear support portion.

11 Claims, 8 Drawing Sheets

(56) References Cited

U.S. PATENT DOCUMENTS 10,638,810 B1 * 5/2020 Cheney ..... A43B 11/00
10,905,192 B1 * 2/2021 Cheney ..... A43B 3/248
11,191,321 B2 * 12/2021 Kilgore ..... A43B 3/0063
2002/0174568 A1 * 11/2002 Neiley ..... A43C 11/14 36/50.1
2004/0020081 A1 * 2/2004 Symons ..... A43B 17/18 36/117.1
2006/0277798 A1 * 12/2006 Reilly ..... A43B 7/144 36/76 HH
2010/0319216 A1 * 12/2010 Grenzke ..... A43C 1/00 36/54
2011/0078922 A1 * 4/2011 Cavaliere ..... A43B 23/025 36/54
2011/0185592 A1 * 8/2011 Nishiwaki ..... A43B 7/16 36/69
2012/0180338 A1 7/2012 Lin
2012/0198730 A1 * 8/2012 Burch ..... A43B 23/0215 36/30 R
2012/0255205 A1 * 10/2012 Jensen ..... B29D 35/144 36/25 R
2012/0317839 A1 * 12/2012 Pratt ..... A43B 11/00 36/102
2014/0305005 A1 * 10/2014 Yeh ..... A43B 7/143 36/69
2016/0088901 A1 * 3/2016 Mahoney ..... A43B 23/0235 36/108
2016/0366982 A1 * 12/2016 Chaney ..... A43B 3/20
2017/0231319 A1 * 8/2017 Bohnsack ..... A43B 7/28 36/92
2018/0110287 A1 * 4/2018 Hopkins ..... A43C 1/00
2018/0110289 A1 * 4/2018 Owings ..... A43C 11/008
2018/0110292 A1 * 4/2018 Beers ..... A43B 11/00
2018/0338583 A1 * 11/2018 Sullivan ..... A43C 11/008
2019/0313741 A1 * 10/2019 Bell ..... A43B 1/0054
2020/0205518 A1 * 7/2020 Hopkins ..... A43B 23/088
2020/0205524 A1 * 7/2020 Hatfield ..... A43C 11/008

FOREIGN PATENT DOCUMENTS

EP 3799758 A1 * 4/2021 ..... A43B 23/0275
JP 3212460 U 9/2017
KR 1020190068953 A 6/2019
WO 2012/168956 A1 12/2012

* cited by examiner

SHOES

CROSS-REFERENCE TO RELATED APPLICATIONS

Priority to Korean patent application numbers 10-2020-0013451 filed on Feb. 5, 2020 and 10-2020-0103307 filed on Aug. 18, 2020 the entire disclosure of which is incorporated by reference herein, is claimed.

BACKGROUND OF THE DISCLOSURE

Field of the Disclosure

The present disclosure relates to shoes, and more particularly, to shoes which are easy to wear.

Related Art

In general, shoes are used to protect feet when a wearer stands or walks on the ground, and may include an upper leather which protects a top side of the feet and a joint and a sole which protects a bottom thereof. An entrance of the shoes is made smaller than the size of the feet to prevent the shoes from loosening and peeling off when the shoes are worn. Accordingly, when the wearer wears the shoes, the wearer bows a waist of the wearer or using a shoehorn. In order to solve this discomfort, a development of shoes which are easy to wear is continuously being performed.

In the prior art, shoes which are easy to wear have already been disclosed in Korean Patent Publication No. 2019-0068953 (multifunctional shoes which are easy to wear, Jun. 19, 2019)". The disclosed invention provides a support portion of a material having excellent deformation and elasticity so that deformation of shoes when the shoes are worn is minimized.

However, in the shoes of the related art which are easy to wear, an upper leather and a tongue should be arranged after the shoes are worn because deformation of the upper leather and the tongue is generated even if the user wears the shoes without bowing a waist of the user. Accordingly, in the shoes of the related art which are easy to wear, there are problems in that the wearer bows the waist after the wearer wears the shoes to arrange the upper leather and the tongue, and thus, the wearer should bow the waist. In particular, it is very difficult for a patient with physical disabilities to blow the waist to wear shoes.

SUMMARY OF THE DISCLOSURE

The present disclosure provides shoes which maintains shapes of an upper leather and a tongue so that a user can easily wear the shoes without bowing a waist of the user when the user wears the shoes.

In an aspect, there is provided a shoe including: a sole; an upper leather which is provided above the sole and includes a tip line forming a region into which a foot of a wearer is inserted; and a first wearing guide portion which causes a rear region of the tip line to be pushed rearward when the foot of the wearer is inserted into the shoe through the tip line, in which the first wearing guide portion includes a rear support portion which is elongated in a heel tab direction from a back counter, and an insertion guide portion which is provided to have a curve rearward from an upper portion of the rear support portion.

The first wearing guide portion may be formed of an elastic material to have a restoring force.

The first wearing guide portion may further include first and second side extension portions which are connected to the rear support portion and reinforce the rear support portion, the first side extension portion may include a first side extension member extending toward a first side from a lower portion of the rear support portion and a first inclination connection member which connects the first side extension member to an upper portion of the rear support portion, and the second side extension portion may include a second side extension member extending toward a second side from the lower portion of the rear support portion and a second inclination connection member which connects the second side extension member to the upper portion of the rear support portion.

The shoe may further include first and second upper leather support portions which are provided on the first and second sides of the upper leather and reinforce the sides of the upper leather, the first upper leather support portion may include a first side connection member which forms a lower portion of the first upper leather support portion, a first front connection member which is provided to be inclined forward and upward from the first side connection member, and a first rear connection member which is provided to be inclined rearward and upward from the first side connection member, and the second upper leather support portion may include a second side connection member which forms a lower portion of the second upper leather support portion, a second front connection member which is provided to be inclined forward and upward from the second side connection member, and a second rear connection member which is provided to be inclined rearward and upward from the second side connection member.

The first wearing guide portion and the first and second upper leather support portions may be formed integrally with each other, the first upper leather support portion may further include a first connection member which connects the first front connection member to the first rear connection member and connects the first rear connection member to the first inclination connection member, and the second upper leather support portion may further include a second connection member which connects the second front connection member to the second rear connection member and connects the second rear connection member to the second inclination connection member.

The upper leather may include a tongue which is provided on a front side of the tip line, and a tongue support portion connects the tongue to the upper leather support portion and fixes a position of the tongue when the foot of the wearer is inserted into the shoe through the tip line.

The tongue support portion may include a support ring which is pivotably connected to the front connection member, and an insertion portion which is provided in a groove shape in the tongue and forms a space into which the support ring is inserted.

The support ring may have a shape in which at least one region is bent and a free end of a region inserted into the insertion portion is extended outward.

The tongue support portion may include a fixing strap which is extended outward from the tongue and includes at least one fixing hole formed in the extended region, and a fixing portion which is provided in the front connection member and is fastened to the fixing hole.

The tongue support portion may be provided in a VELCRO® form to connect the tongue and the front connection member to each other.

The shoe may further include a second wearing guide portion which reduces a friction between the foot of the wearer and the tip line when the foot of the wearer is inserted into the shoe through the tip line and causes the rear region of the tip line to be pushed rearward.

The second wearing guide portion may include at least one roller which is disposed in the rear region of the tip line and a wire which supports the roller.

The tip line may include an accommodation groove which forms a space in which the roller is accommodated and disposes the tip line and the roller so that a height of the tip line is the same as a center of the roller.

The wire may extend to the front region of the tip line and is connected to an operation unit located in the front region of the tip line, and the operation unit may have a Boa system to adjust a length of the wire.

The roller may include a soft material.

DESCRIPTION OF EXEMPLARY EMBODIMENTS

Figure 1:
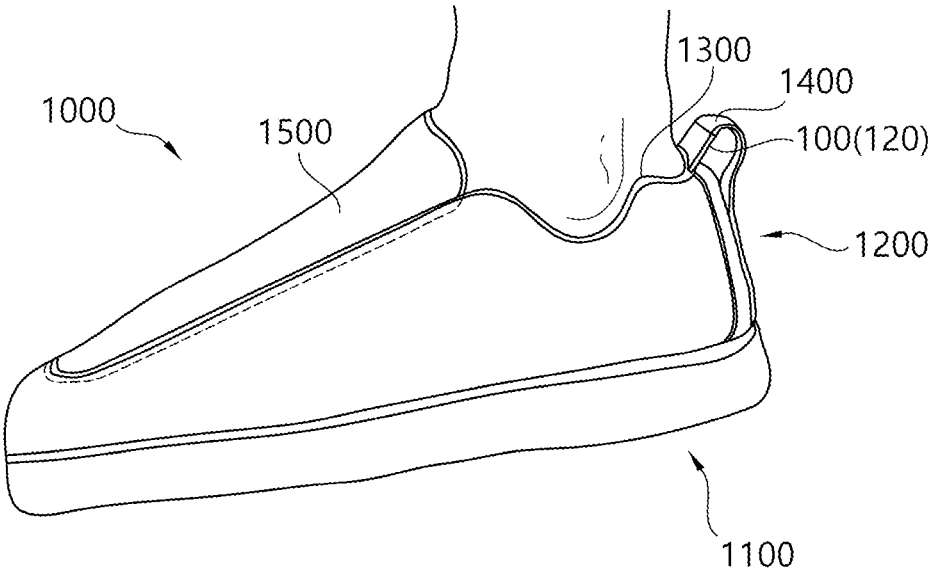
FIG. 1 is a perspective view illustrating a shoe according to a first embodiment.

Hereinafter, embodiments of the present disclosure will be described in detail with reference to the accompanying drawings. However, the embodiments are not limited to those disclosed below and may be implemented in various forms. The embodiments allow the present disclosure to be complete, and provide to completely inform the scope of the invention to a person skilled in the art. Shapes of the elements in the drawings may have exaggerated portions for a clearer description, and elements indicated by the same reference numerals in the drawings refer to the same elements.

Figure 2:
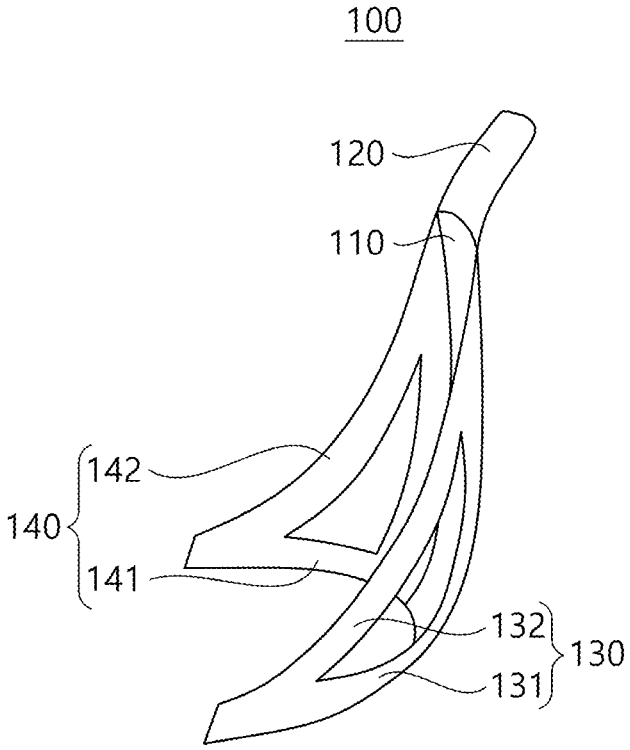
FIG. 2 is a perspective view illustrating a first wearing guide portion.

FIG. 1 is a perspective view illustrating a shoe according to a first embodiment, and FIG. 2 is a perspective view illustrating a first wearing guide portion.

As illustrated in FIGS. 1 and 2, a shoe 1000 according to the first embodiment includes a sole 1100 and an upper leather 1200.

The sole 1100 forms a bottom of the shoe 1000 to protect a sole of a wearer, and the upper leather 1200 protects a top side of a foot and a joint of the wearer above the sole 1100.

Here, the shoe 1000 may be provided in various ways, such as sneakers, boots, and shoes, and the type of the shoe 1000 is not limited.

Meanwhile, a top line 1300 into which the foot of the wearer is inserted is formed in the shoe 1000. The top line 1300 is formed between a rear region which can include a heel tab and a back counter, both side regions which can respectively include a collar, and a front region which includes a tongue 1500.

Moreover, in the shoe 1000, a first wearing guide portion 100 may be provided between an inner skin and an outer skin. However, this is for explaining the present embodiment, and the first wearing guide portion 100 may be selectively provided on an inner surface or an outer surface of the shoe 1000.

The first wearing guide portion 100 causes the top line 1300 to be pushed toward the rear region when the shoe is worn, and thus, the wearer can wear the shoe more easily. That is, when the wearer inserts a foot into the shoe 1000 through the top line 1300, the first wearing guide portion 100 causes the foot to move toward the front region and the rear region of the top line 1300 to move rearward.

For example, the first wearing guide portion 100 may include a rear support portion 110, an insertion guide portion 120, a first side extension portion 130, and a second side extension portion 140.

The rear support portion 110 is provided to be elongated in a height direction of the shoe 1000, and may be elongated in a heel tap direction from the back counter inside the shoe 1000.

Moreover, the insertion guide portion 120 is provided above the rear support portion 110 and is exposed to an upper portion of the shoe 1000. The insertion guide portion 120 may be provided to have a curve toward a rear side of the shoe 1000 from the rear support portion 110. Accordingly, when the foot of the wearer is inserted into the shoe through the tip line 1300, the insertion guide portion 120 causes the heel tab to move rearward while causing the foot of the wearer is smoothly inserted into a front side of an inside of the shoe 1000. Here, the insertion guide portion 120 may be connected to a hook portion 1400 which may be provided on a rear surface of the shoe 1000, but is not limited thereto.

In addition, the first side extension portion 130 is disposed to protrude from the rear support portion 110 toward a first side. In this case, the first side extension portion 130 may include a first side extension member 131 and a first inclination connection member 132. The first side extension member 131 extends in a collar direction from a lower portion of the rear support 110, and the first inclination connection member 132 may be disposed to have an inclination in the heel tab direction from a free end of the first side extension member 131 and connected to an upper portion of the rear support portion 110.

The second side extension portion 140 is disposed to protrude from a rear support portion 110 toward a second side. In this case, the second side extension portion 140 may include a second side extension member 141 and a second inclination connection member 142. The second side extension member 141 extends in the collar direction from the lower portion of the rear support portion 110, the second inclination connection member 142 may be disposed to have an inclination in the heel tab direction from a free end of the second side extension member 141 and connected to an upper portion of the rear support portion 110.

Accordingly, the first side extension portion 130 and the second side extension portion 140 extend to both sides of the rear support portion 110 to reinforce the rear support portion 110.

Meanwhile, in the first wearing guide portion 100, the rear support portion 110, the insertion guide portion 120, the first side extension portion 130, and the second side extension portion 140 may be formed integrally with each other.

Moreover, the first wearing guide portion 100 is formed of an elastic material to have a restoring force. Accordingly, when the foot is inserted into the shoe, the first wearing guide portion 100 causes the foot to be smoothly inserted into the shoe through the tip line 1300 and prevents the rear region of the shoe 1000 from being easily bent or an intermediate portion thereof from being bent.

Meanwhile, hereinafter, shoes according to other embodiments will be described in detail with reference to the accompanying drawings. However, detailed descriptions of the above-described components are omitted, and the same reference numerals are assigned to the components.

Figure 3:
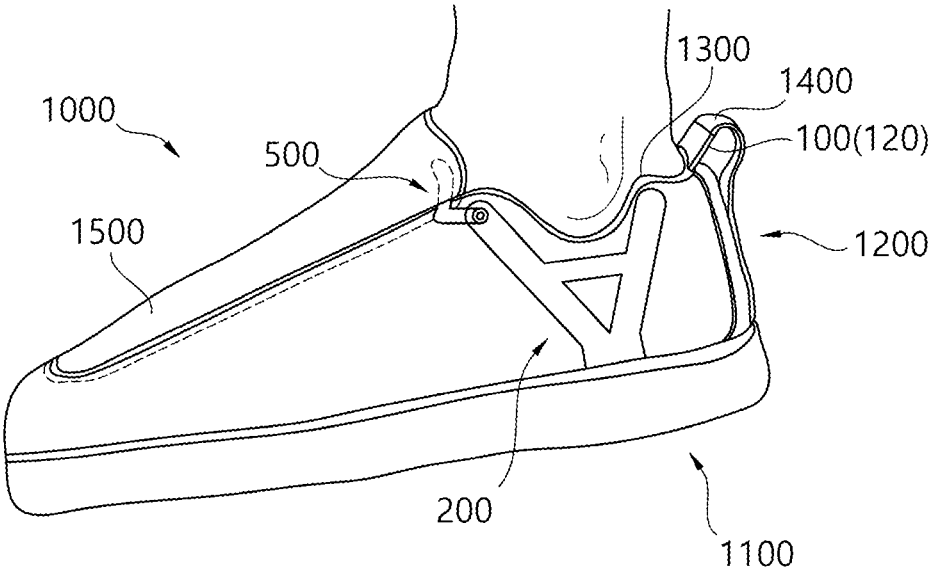
FIG. 3 is a perspective view illustrating a shoe according to a second embodiment.
Figure 4:
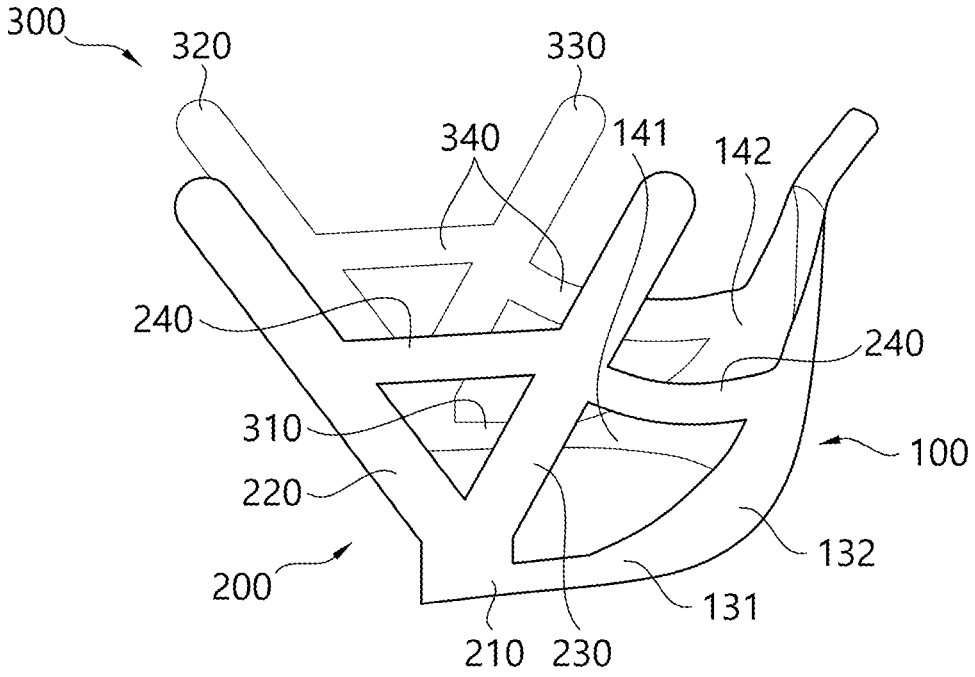
FIG. 4 is a perspective view illustrating a first wearing guide portion and an upper leather support portion of a shoe according to the second embodiment.
Figure 5:
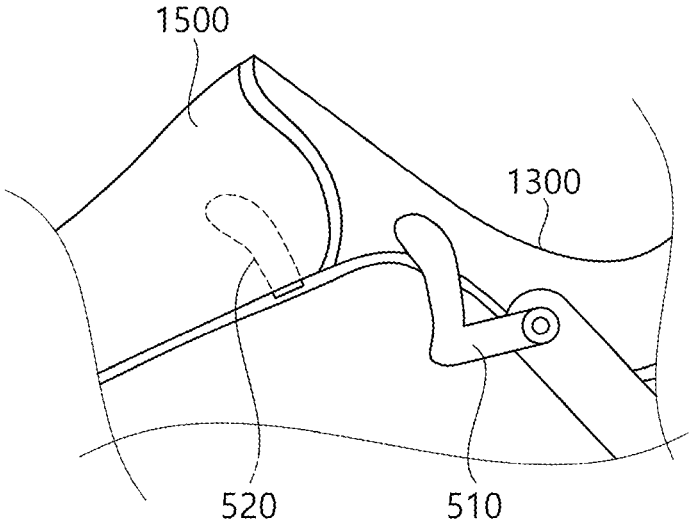
FIG. 5 is a conceptual view illustrating a tongue support portion of the shoe according to the second embodiment.

FIG. 3 is a perspective view illustrating a shoe according to a second embodiment, and FIG. 4 is a perspective view illustrating a first wearing guide portion and an upper leather support portion of a shoe according to the second embodiment. FIG. 5 is a conceptual view illustrating a tongue support portion of the shoe according to the second embodiment.

As illustrated in FIGS. 3 to 5, a shoe 1000 according to a second embodiment may include a first upper leather support portion 200, a second upper leather support portion 300, and a tongue support portion 500.

First, the first upper leather support portion 200 may be disposed between an inner skin and an outer skin of the shoe 1000 on a first side, but is not limited thereto. The first upper leather support portion 200 may extend the first side extension portion 130, and may include a first side connection member 210, a first front connection member 220, a first rear connection member 230, and a first connection member 240.

The first side connection member 210 is connected to the first side extension member 131 and forms a lower portion of the first upper leather support portion 200. Moreover, the first front connection member 220 extends from the first side connection member 210 and may be disposed to be inclined forward and upward from the first side connection member 210. In this case, a free end of the first front connection member 220 may extend to be adjacent to a tongue 1500. Moreover, the first rear connection member 230 may extend from the first side connection member 210 and may be disposed to be included rearward and upward from the first side connection member 210. Here, the first front connection member 220 and the first rear connection member 230 may be disposed to be symmetrical with each other, but are not limited thereto. Moreover, the first connection member 240 may be disposed to connect an intermediate region between the first front connection member 220 and the first rear connection member 230 and connect an intermediate region between the first rear connection member 230 and the first inclination connection member 132.

Moreover, the second upper leather support portion 300 may be disposed between the inner skin and the outer skin of the shoe 1000 on a first side, but is not limited thereto. The second upper leather support portion 300 may extend the second side extension portion 140, and may include a second side connection member 310, a second front connection member 320, a second rear connection member 330, and a second connection member 340.

The second side connection member 310 is connected to the second side extension member 141 and forms a lower portion of the second upper leather support portion 300. Moreover, the second front connection member 320 extends from the second side connection member 310 and may be disposed to be inclined forward and upward from the second side connection member 310. In this case, a free end of the second front connection member 320 may extend to be adjacent to the tongue 1500. Moreover, the second rear connection member 330 may extend from the second side connection member 310 and may be disposed to be included rearward and upward from the second side connection member 310. Here, the second front connection member 320 and the second rear connection member 330 may be disposed to be symmetrical with each other, but are not limited thereto. Moreover, the second connection member 340 may be disposed to connect an intermediate region between the second front connection member 320 and the second rear connection member 330 and connect an intermediate region between the second rear connection member 330 and the second inclination connection member 142.

Each of the first upper leather support portion 200 and the second upper leather support portion 300 is formed of an elastic material to have a restoring force. Accordingly, when the foot is inserted into the shoe 100 through the tip line 1300, the first upper leather support portion 200 and the second upper leather support portion 300 can prevent both side regions of the shoe 1000 adjacent to the tip line 1300 from being easily bent or an intermediate portion thereof from being bent.

Meanwhile, in the present embodiment, the case where the first wearing guide portion 100, the first upper leather support portion 200, and the second upper leather support portion 300 are formed of one body is described. However, this is for explaining the present embodiment, and the first wearing guide portion 100, the first upper leather support portion 200, and the second upper leather support portion 300 may be separated from each other.

Meanwhile, the tongue support portion 500 fixes a position of the tongue 1500 when the foot of the wearer is inserted into the shoe 1000 through the tip line 1300 so that the wearing is more easily performed, and thus, it is not necessary to arrange the tongue 1500 after the wearing. The tongue support portion 500 may be provided on both sides of the shoe 1000, respectively, and a case where the tongue support portion 500 is disposed on the first side will be described below.

The tongue support portion 500 may include a support ring 510 which is pivotally connected to the first front connection member 220. The support ring 510 is provided so that at least one region is bent. Accordingly, one region of the support ring 510 is inserted into a groove-shaped insertion portion 520 which is formed in the tongue 1500, and thus, the tongue 1500 is prevented from being rolled into an inside of the shoe 1000 through the tip line 1300. The support ring 510 is provided to have a shape in which a free end of a region inserted into the insertion portion 520 extends outwardly or has a predetermined curve, and thus, the support ring 50 can support the tongue 1500 more firmly. Accordingly, the wearer inserts the support ring 510 into the insertion portion 520 to fix the tongue 1500 when necessary, and detaches the support ring 510 from the insertion portion 520 to release the fixing of the tongue 1500 when unnecessary.

Figure 6:
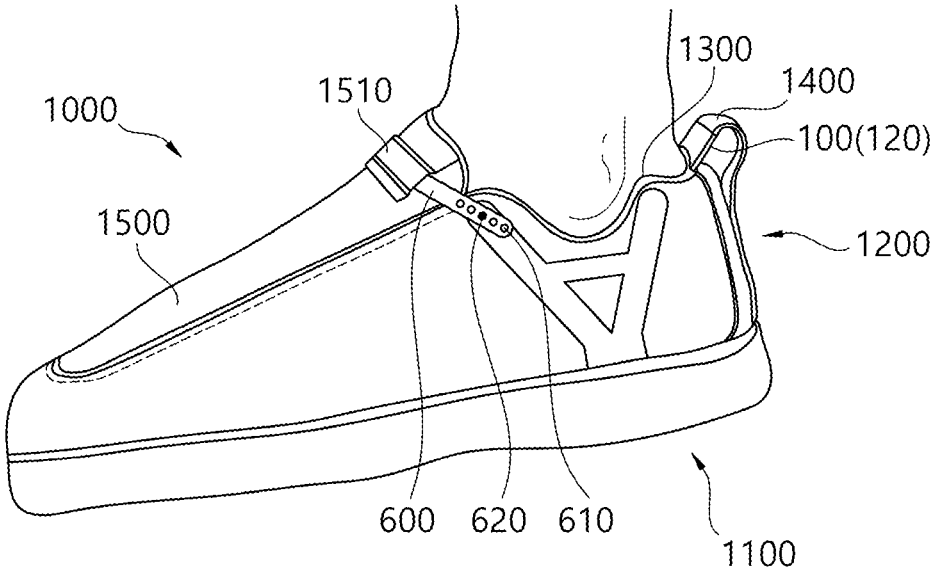
FIG. 6 is a conceptual view illustrating a tongue support of the shoe according to the third embodiment.

FIG. 6 is a conceptual view illustrating a tongue support of the shoe according to the third embodiment.

As illustrated in FIG. 6, in a shoe 1000 according to third embodiment, the tongue support portion 500 may be provided in a fastening method.

Here, the tongue support portion 500 may include a fixing strap which is provided in the tongue 1500. The fixing strap 600 extends toward both sides of the tongue 1500 from the tongue 1500. In this case, the fixing strap 600 may be fixed to the tongue 1500 or may be supported by a strap support portion 1510 formed in the tongue 1500.

Moreover, a plurality of fixing holes 610 may be arranged in at least one region of the fixing strap 600 extending toward a side of the tongue 1500. Here, a selected fixing hole 610 is fastened to a fixing portion 620 which is formed to protrude from each of the first front connection member 220 and the second front connection member 320, and thus, the tongue 1500 is prevented from being rolled into the inside of the shoe 1000 through the tip line 1300 when the wearer wears the shoe.

However, this is for explaining the present embodiment. That is, the tongue support portion 500 may be formed in various manners including a VELCRO® form so that the tongue 1500 can be fixed to the first front connection member 220 and second front connection members 320.

Figure 7:
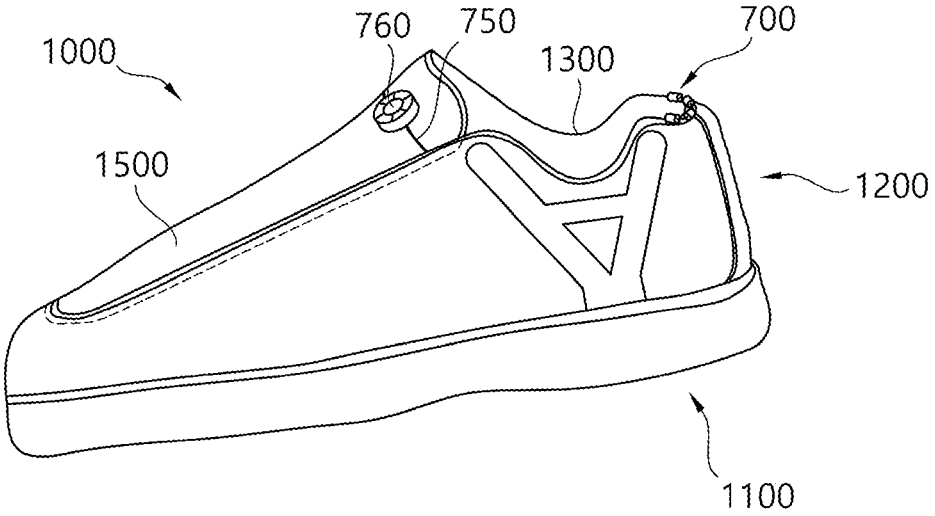
FIG. 7 is a perspective view illustrating a shoe according to a fourth embodiment.
Figure 8:
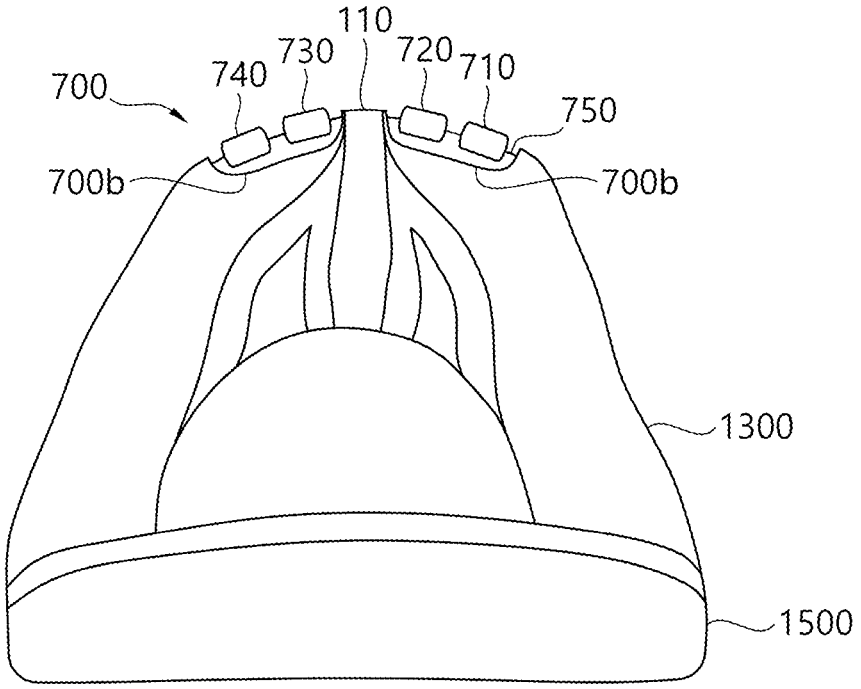
FIG. 8 is a conceptual view illustrating a second wearing guide portion of the shoe according to the fourth embodiment.

FIG. 7 is a perspective view illustrating a shoe according to a fourth embodiment, and FIG. 8 is a conceptual view illustrating a second wearing guide portion of the shoe according to the fourth embodiment.

As illustrated in FIGS. 7 and 8, a shoe according to the fourth embodiment may include a second wearing guide portion 700.

The second wearing guide portion 700 may include a first roller 710, a second roller 720, a third roller 730, and a fourth roller 740 are provided in the heel tab so that the wearer easily wears the shoe.

Here, the first roller 710 and the second roller 720 may be provided in the heel tab on the first side based on the rear support portion 110. In this case, the heel tab include a first accommodation groove 700*a* for forming a space in which the first roller 710 and the second roller 720 are disposed, and centers of the first roller 710 and the second roller 720 may be disposed to be located at the same height as that of the tip line 1300. Moreover, the third roller 730 and the fourth roller 740 may be provided in the heel tab on the second side based on the rear support portion 110. In this case, the heel tab include a second accommodation groove 700*a* for forming a space in which the third roller 730 and the fourth roller 740 are disposed, and centers of the third roller 730 and the fourth roller 740 may be disposed to be located at the same height as that of the tip line 1300.

In this way, the plurality of rollers 710, 720, 730, and 740 are provided in the heel tab, and thus, a friction between the foot of the wearer and the heel tab can be reduced when the foot is inserted into the shoe 1000 through the tip line 1300, the foot can move toward the front region, and the rear region can move rearward. Here, each of the plurality of rollers 710, 720, 730, and 740 is provided to include a soft material such as rubber or sponge so that a pain of the wearer does not occur when the wearer wears the shoe.

Meanwhile, the plurality of rollers 710, 720, 730, and 740 may be supported by a wire to be rotated, and the wire 750 may extends to an upper region of the tongue 1500. Here, the wire 750 may pass through a wire tube (not illustrated) supported by the rear connection members 230 and 330 and the front connection members 220 and 320 and may extend to an operation unit 760 which is provided above the tongue 1500. Here, the operation unit 760 may be provided in the form of a dial such as a Boa system, and is provided to adjust a length of the wire 750. Accordingly, a diameter of the tip line 1300 may be changed according to the length adjustment of the wire 750 supporting the plurality of rollers 710, 720, 730, and 740. Therefore, the wearer changes the diameter of the tip line 1300 according to a body size and can stably wear the shoe 1000 and protect an ankle.

As described above, in the shoe according to the present disclosure, an entrance of the shoe is naturally expanded while the shapes of the upper leather and the tongue are maintained when the wearer wears the shoe, and thus, the wearer can easily wear the shoe.

Moreover, in the shoe according to the present disclosure, even patients and children who are difficult to wear a shoe can easily wear the shoe of the present disclosure themselves without discomfort.

The embodiments of the present disclosure described above and illustrated in the drawings should not be interpreted as limiting a technical spirit of the present disclosure.

A protection scope of the present disclosure is limited only by the matters described in the claims, and a person having ordinary knowledge in a technical field of the present disclosure can improve and modify a technical idea of the present disclosure in various forms. Therefore, the improvements and modifications will fall within a protection of the present disclosure as long as apparent to a person having ordinary knowledge.

In the shoe according to the present disclosure, an entrance of the shoe is naturally expanded while the shapes of the upper leather and the tongue are maintained when the wearer wears the shoe, and thus, the wearer can easily wear the shoe.

Moreover, in the shoe according to the present disclosure, even patients and children who are difficult to wear a shoe can easily wear the shoe of the present disclosure themselves without discomfort.

Technical effects of the present disclosure as described above are not limited to the effects mentioned above, and other technical effects not mentioned will be clearly understood by a person skilled in the art from the above description.

What is claimed is:

1. A shoe comprising:

a sole;

an upper leather which is provided above the sole and includes a tip line forming a region into which a foot of a wearer is inserted;

a first wearing guide portion which causes a rear region of the tip line to be pushed rearward when the foot of the wearer is inserted into the shoe through the tip line;

a second wearing guide portion which reduces a friction between the foot of the wearer and the tip line when the foot of the wearer is inserted into the shoe through the tip line and causes the rear region of the tip line to be pushed rearward; and a first upper leather support portion which is provided on a first side of the upper leather and reinforce the first side of the upper leather, wherein the first wearing guide portion includes:

a rear support portion which is elongated in a heel tab direction from a back counter;

an insertion guide portion which is provided to have a curve rearward from an upper portion of the rear support portion; and a first side extension portion which is connected to the rear support portion and reinforces the rear support portion, the first side extension portion including a first side extension member extending toward a first side from a lower portion of the rear support portion and a first inclination connection member which connects the first side extension member to an upper portion of the rear support portion, wherein the first upper leather support portion includes a first side connection member which forms a lower portion of the first upper leather support portion and is connected to the first side extension member, wherein the second wearing guide portion includes at least one roller which is disposed in the rear region of the tip line and a wire which supports the at least one roller, and wherein the wire extends to a front region of the tip line and is connected to an operation unit located in the front region of the tip line, and the operation unit has a Boa system to adjust a length of the wire.

2. The shoe of claim 1, wherein the first wearing guide portion is formed of an elastic material to have a restoring force.

3. The shoe of claim 2, wherein the first wearing guide portion further includes a second side extension portion which is connected to the rear support portion and reinforces the rear support portion, and wherein the second side extension portion includes a second side extension member extending toward a second side from the lower portion of the rear support portion and a second inclination connection member which connects the second side extension member to the upper portion of the rear support portion.

4. The shoe of claim 3, further comprising:

a second upper leather support portion which is provided on a second side of the upper leather and reinforce the second side of the upper leather, wherein the first upper leather support portion further includes a first front connection member which is provided to be inclined forward and upward from the first side connection member, and a first rear connection member which is provided to be inclined rearward and upward from the first side connection member, and wherein the second upper leather support portion includes a second side connection member which forms a lower portion of the second upper leather support portion, a second front connection member which is provided to be inclined forward and upward from the second side connection member, and a second rear connection member which is provided to be inclined rearward and upward from the second side connection member.

5. The shoe of claim 4, wherein the first wearing guide portion and the first and second upper leather support portions are formed integrally with each other.

6. The shoe of claim 1, wherein the tip line includes an accommodation groove which forms a space in which the roller is accommodated and disposes the tip line and the roller so that a height of the tip line is the same as a center of the roller.

7. The shoe of claim 1, wherein the at least one roller includes a soft material.

8. The shoe of claim 1, wherein the first upper leather support portion further includes a first front connection member which is provided to be inclined forward and upward from the first side connection member, and a first rear connection member which is provided to be inclined rearward and upward from the first side connection member, the first front connection member and the first rear connection member being disposed symmetrically with respect to each other.

9. A shoe comprising:

a sole;

an upper leather which is provided above the sole and includes a tip line forming a region into which a foot of a wearer is inserted;

a first wearing guide portion which causes a rear region of the tip line to be pushed rearward when the foot of the wearer is inserted into the shoe through the tip line; and a first upper leather support portion which is provided on a first side of the upper leather and reinforce the first side of the upper leather; and a second upper leather support portion which is provided on a second side of the upper leather and reinforce the second side of the upper leather, wherein the first wearing guide portion includes:

a rear support portion which is elongated in a heel tab direction from a back counter;

an insertion guide portion which is provided to have a curve rearward from an upper portion of the rear support portion;

a first side extension portion which is connected to the rear support portion and reinforces the rear support portion, the first side extension portion including a first side extension member extending toward a first side from a lower portion of the rear support portion and a first inclination connection member which connects the first side extension member to an upper portion of the rear support portion; and a second side extension portion which is connected to the rear support portion and reinforces the rear support portion, the second side extension portion including a second side extension member extending toward a second side from the lower portion of the rear support portion and a second inclination connection member which connects the second side extension member to the upper portion of the rear support portion, wherein the first upper leather support portion includes a first side connection member which forms a lower portion of the first upper leather support portion and is connected to the first side extension member, a first front connection member which is provided to be inclined forward and upward from the first side connection member, and a first rear connection member which is provided to be inclined rearward and upward from the first side connection member, wherein the first wearing guide portion is formed of an elastic material to have a restoring force, wherein the second upper leather support portion includes a second side connection member which forms a lower portion of the second upper leather support portion, a second front connection member which is provided to be inclined forward and upward from the second side connection member, and a second rear connection member which is provided to be inclined rearward and upward from the second side connection member, wherein the upper leather includes a tongue which is provided on a front side of the tip line, and a tongue support portion connects the tongue to the upper leather support portion and fixes a position of the tongue when the foot of the wearer is inserted into the shoe through the tip line, and wherein the tongue support portion includes a support ring which is pivotably connected to the first front connection member, and an insertion portion which is provided in a groove shape in the tongue and forms a space into which the support ring is inserted.

10. The shoe of claim 9, wherein the support ring has a shape in which at least one region is bent and a free end of a region inserted into the insertion portion is extended outward.

11. A shoe comprising:

a sole;

an upper leather which is provided above the sole and includes a tip line forming a region into which a foot of a wearer is inserted;

a first wearing guide portion which causes a rear region of the tip line to be pushed rearward when the foot of the wearer is inserted into the shoe through the tip line; and a first upper leather support portion which is provided on a first side of the upper leather and reinforce the first side of the upper leather; and a second upper leather support portion which is provided on a second side of the upper leather and reinforce the second side of the upper leather, wherein the first wearing guide portion includes:

a rear support portion which is elongated in a heel tab direction from a back counter;

an insertion guide portion which is provided to have a curve rearward from an upper portion of the rear support portion;

a first side extension portion which is connected to the rear support portion and reinforces the rear support portion, the first side extension portion including a first side extension member extending toward a first side from a lower portion of the rear support portion and a first inclination connection member which connects the first side extension member to an upper portion of the rear support portion; and a second side extension portion which is connected to the rear support portion and reinforces the rear support portion, the second side extension portion including a second side extension member extending toward a second side from the lower portion of the rear support portion and a second inclination connection member which connects the second side extension member to the upper portion of the rear support portion, wherein the first upper leather support portion includes a first side connection member which forms a lower portion of the first upper leather support portion and is connected to the first side extension member, a first front connection member which is provided to be inclined forward and upward from the first side connection member, and a first rear connection member which is provided to be inclined rearward and upward from the first side connection member, wherein the first wearing guide portion is formed of an elastic material to have a restoring force, wherein the second upper leather support portion includes a second side connection member which forms a lower portion of the second upper leather support portion, a second front connection member which is provided to be inclined forward and upward from the second side connection member, and a second rear connection member which is provided to be inclined rearward and upward from the second side connection member, wherein the upper leather includes a tongue which is provided on a front side of the tip line, and a tongue support portion connects the tongue to the upper leather support portion and fixes a position of the tongue when the foot of the wearer is inserted into the shoe through the tip line, and wherein the tongue support portion includes a fixing strap which is extended outward from the tongue and includes at least one fixing hole formed in an extended region, and a fixing portion which is provided in each of the first and second front connection members and is fastened to the fixing hole.

* * * * *